US008475202B1

(12) United States Patent
Chiang

(10) Patent No.: US 8,475,202 B1
(45) Date of Patent: Jul. 2, 2013

(54) DETECTION TERMINAL WITH A CONCAVE SURFACE AND A CONVEX SURFACE BOTH FACING A SIDE WALL OF A TONGUE OF A HOUSING

(75) Inventor: Jui-Tu Chiang, New Taipei (TW)

(73) Assignee: Taiwin Electronics Co., Ltd, New Taipei (TW)

( * ) Notice: Subject to any disclaimer, the term of this patent is extended or adjusted under 35 U.S.C. 154(b) by 0 days.

(21) Appl. No.: 13/423,654

(22) Filed: Mar. 19, 2012

(51) Int. Cl.
*H01R 3/00* (2006.01)

(52) U.S. Cl.
USPC ..... 439/489

(58) Field of Classification Search
USPC ..... 439/489, 490, 188, 159, 630
See application file for complete search history.

(56) References Cited

U.S. PATENT DOCUMENTS

| | | | | |
|---|---|---|---|---|
| 7,547,220 | B1 * | 6/2009 | Wang et al. | 439/188 |
| 7,891,998 | B1 * | 2/2011 | Gao et al. | 439/159 |
| 8,152,545 | B1 * | 4/2012 | Qu et al. | 439/188 |
| 8,206,174 | B2 * | 6/2012 | Ko | 439/489 |
| 8,262,400 | B1 * | 9/2012 | Qu et al. | 439/188 |

* cited by examiner

*Primary Examiner* — Chandrika Prasad
(74) *Attorney, Agent, or Firm* — Chun-Ming Shih; HDLS IPR Services

(57) ABSTRACT

An electrical connector socket includes an insulation base, a tongue piece and a detection terminal. The insulation base includes a stopping surface. The tongue piece includes a side wall vertically extending from the stopping surface. The detection terminal includes a fixed end embedded into the insulation base, an elastic arm extending from the fixed end in a curved manner with its concave surface facing the side wall, and a contact section continuously extending from the elastic arm in a curved manner with its convex surface facing the side wall.

10 Claims, 7 Drawing Sheets

DETECTION TERMINAL WITH A CONCAVE SURFACE AND A CONVEX SURFACE BOTH FACING A SIDE WALL OF A TONGUE OF A HOUSING

BACKGROUND OF THE INVENTION

1. Field of the Invention

The present invention relates to an electrical connector socket, and in particular to an electrical connector socket having a curved detection terminal.

2. Description of Prior Art

Please refer to FIGS. 1 and 2. The conventional electrical connector socket is provided with a detection terminal 11 in order to prevent against an erroneous electrical conduction of undesired terminals. Only when a connector plug 20 is brought into electrical contact with the detection terminal 11, the connector socket is supplied with electricity. The detection terminal is bent to form a straight elastic arm 12. When the connector plug 20 is inserted into the connector socket, the connector plug 20 abuts against the conventional detection terminal 11 and pushes the straight elastic arm 12. When the connector plug 20 is removed from the connector socket, the straight elastic arm 12 returns to its original position.

The conventional detection terminal 11 of the connector socket has the following problems.

When the conventional detection terminal 11 is manufactured, the bending angle of the elastic arm may exceed ninety degrees, which makes the bending point of the elastic arm to yield due to its excessive deformation. When the straight elastic arm 12 is pushed, stress may be concentrated at the bending point due to its discontinuous profile and large bending angle. According to the existing technique in this art, the terminals of the electrical connector are often made of phosphor bronze. However, the conventional detection terminal 11 made of phosphor bronze may generate permanent deformation due to multiple times of insertion/removal or the violent shaking of the connector plug inserted into the connector socket, which makes the connector plug to poorly contact with connector socket. Further, the connector plug 20 may press the root of the detection terminal 11 easily, which makes the detection terminal 11 to suffer damage.

SUMMARY OF THE INVENTION

The present invention is to provide a detection terminal of an electrical connector socket, which is configured to withstand violent shaking of a connector plug without generating permanent deformation.

The present invention is to provide a detection terminal, which is used in an electrical connector comprising an insulation base and a tongue piece. The insulation base comprises a stopping surface. The tongue piece extends from the insulation base. The tongue piece comprises a side wall vertically extending from the stopping surface. The detection terminal of the present invention comprises a fixed end, an elastic arm, and a contact section. The fixed end is embedded into the insulation base. The elastic arm extends from the fixed end in a curved manner with its concave surface facing the side wall. The contact section continuously extends from the elastic arm in a curved manner with its convex surface facing the side wall.

Preferably, the fixed end comprises a longitudinal section, a transverse section, and a bent section. The longitudinal section is in parallel to the side wall and embedded into the insulation base. The transverse section extends from the longitudinal section along the stopping surface in a direction away from the side wall. The bent section extends from the transverse section to form a curved shape connecting the elastic arm and the transverse section.

Preferably, the detection terminal comprises a guiding section continuously extending from the contact section and forming an angle relative to the side wall.

Preferably, the bent section is smoothly connected to the elastic arm.

The present invention is to provide an electrical connector socket whose detection terminal is configured to withstand violent shaking of a connector plug without generating permanent deformation.

The present invention provides an electrical connector socket, which comprises an insulation base, a tongue piece and a detection terminal. The insulation base comprises a stopping surface. The tongue piece is a plate extending from the insulation base. The tongue piece comprises a side wall vertically extending from the stopping surface. The detection terminal comprises a fixed end embedded in the insulation base, an elastic arm extending from the fixed end in a curved manner with its concave surface facing the side wall, and a contact section continuously extending from the elastic arm in a curved manner with its convex surface facing the side wall.

Preferably, the electrical connector socket further comprises a housing covering the insulation base and surrounding the tongue piece. The housing is provided with an action hole at a position corresponding to the detection terminal.

Preferably, the elastic arm is located in the action hole.

Preferably, the fixed end comprises a longitudinal section, a transverse section and a bent section. The longitudinal section is in parallel to the side wall and embedded in the insulation base. The longitudinal section extends from the longitudinal section along the stopping surface in a direction away from the side wall. The bent section extends from the transverse section to form a curved shape connecting the elastic arm and the transverse section.

Preferably, the detection terminal comprises a guiding section continuously extending from the contact section and forming an angle relative to the side wall.

Preferably, the bent section is smoothly connected to the elastic arm.

Since the elastic arm of the detection terminal of the present invention is formed into a curved shape, the yield of the material and the stress concentration of the elastic arm can be prevented. In comparison with prior art, the detection terminal of the present invention can withstand more violent shaking.

DETAILED DESCRIPTION OF THE INVENTION

Figure 1:
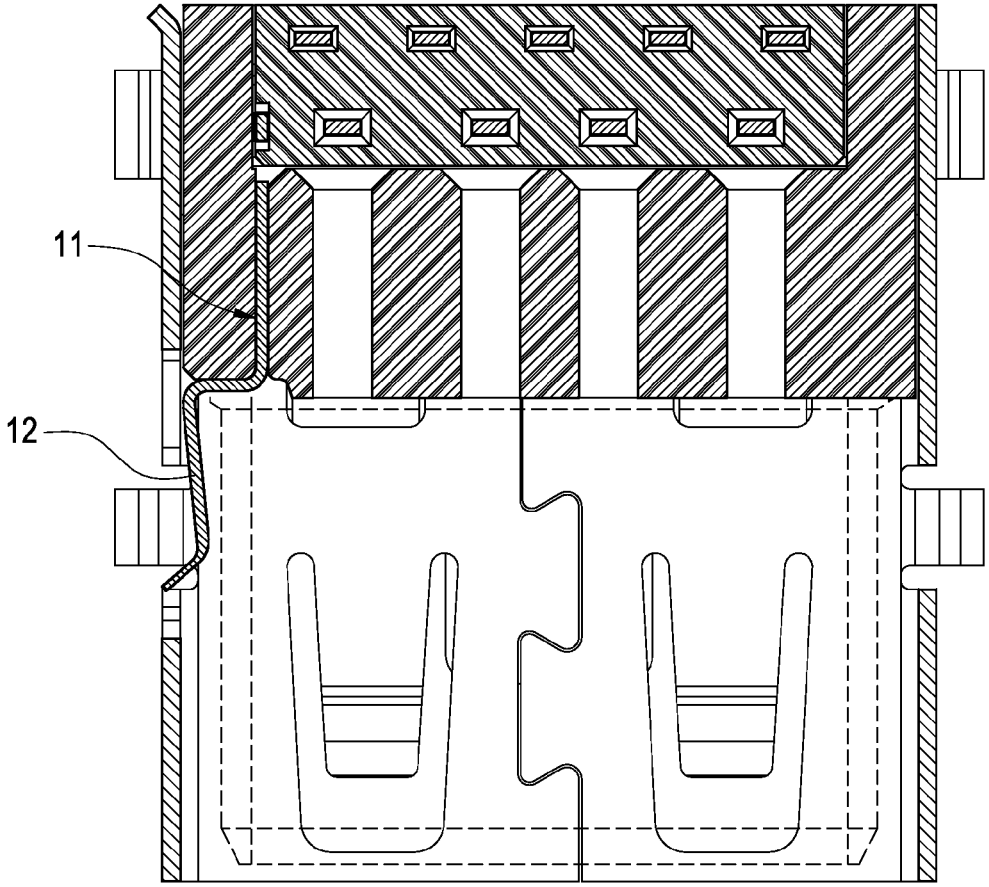
FIG.1 PRIOR ART
FIG. 1 is a cross-sectional view of a conventional electrical socket.
Figure 2:
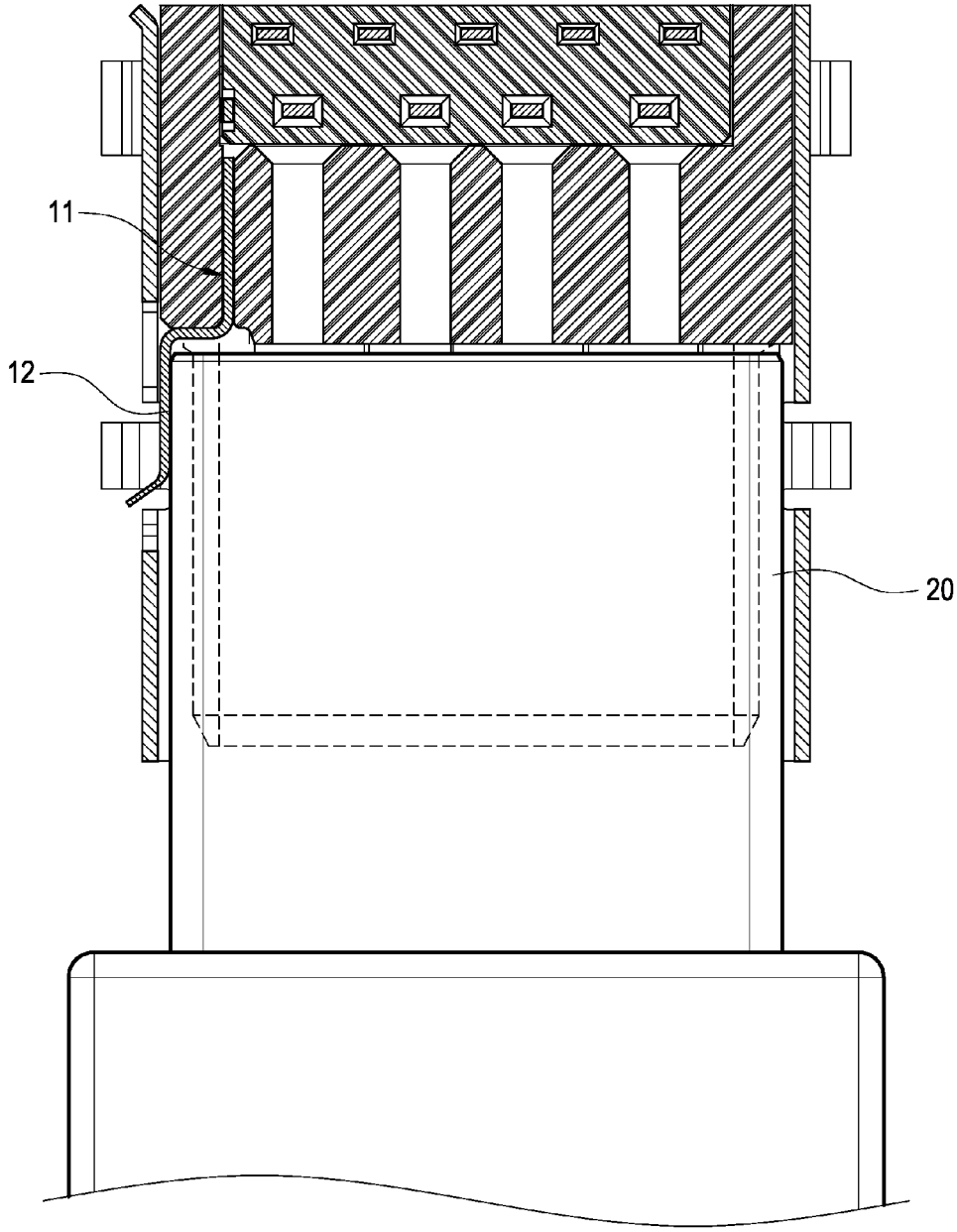
FIG.2 PRIOR ART
FIG. 2 is a cross-sectional view of a conventional connector socket and a connector plug.
Figure 3:
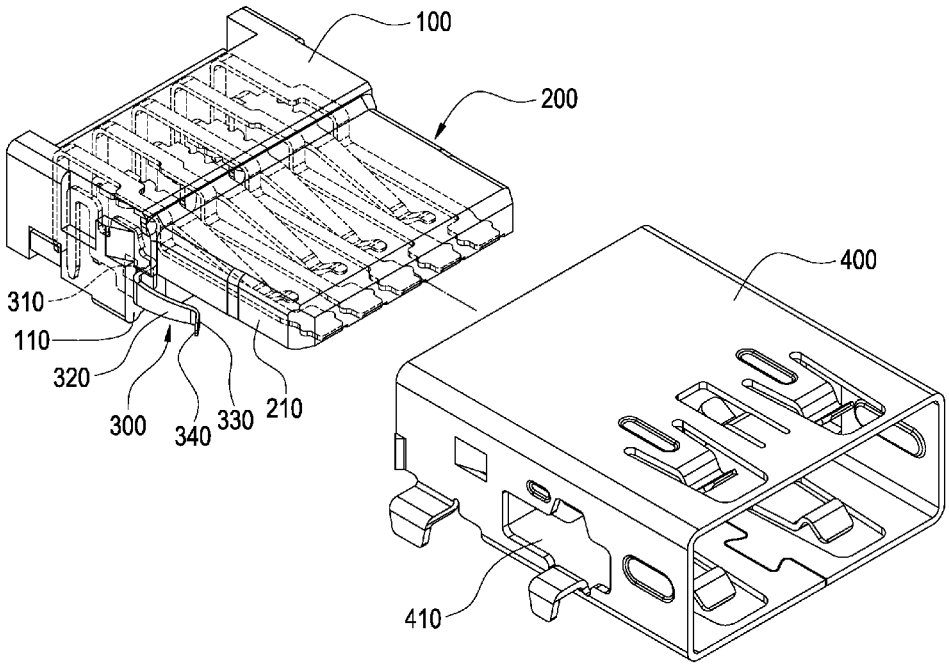
FIG. 3 is an exploded perspective view showing the electrical connector socket according to a preferred embodiment of the present invention.

Please refer to FIG. 3. The present invention provides an electrical connector socket, which includes an insulation base 100, a tongue piece 200, a detection terminal 300 and a housing 400.

The insulation base 100 is preferably made of plastic materials and comprises a stopping surface 110. The tongue piece 200 is a plastic plate vertically and outwardly extending from the stopping surface 110 of the insulation base 100. The tongue piece 200 comprises a side wall 210. The side wall 210 is perpendicular to the stopping surface 110 and extends outwards from the stopping surface 110.

Figure 4:
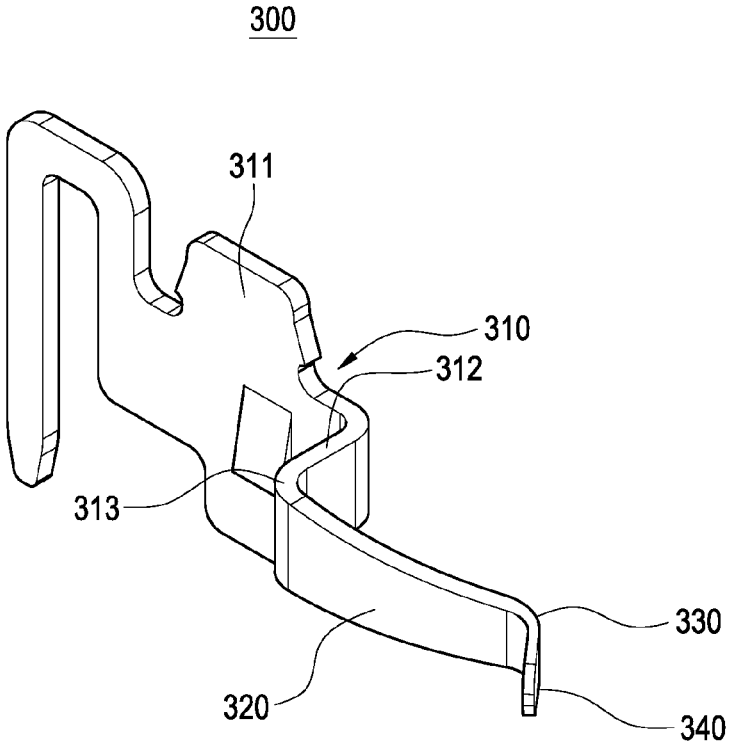
FIG. 4 is a schematic view showing the detection terminal according to a preferred embodiment of the present invention.
Figure 5:
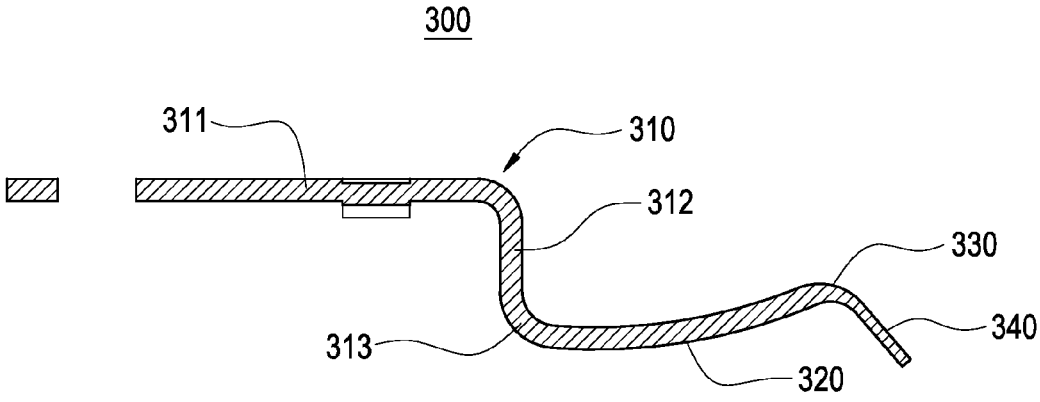
FIG. 5 is a cross-sectional view showing the detection terminal according to a preferred embodiment of the present invention.
Figure 6:
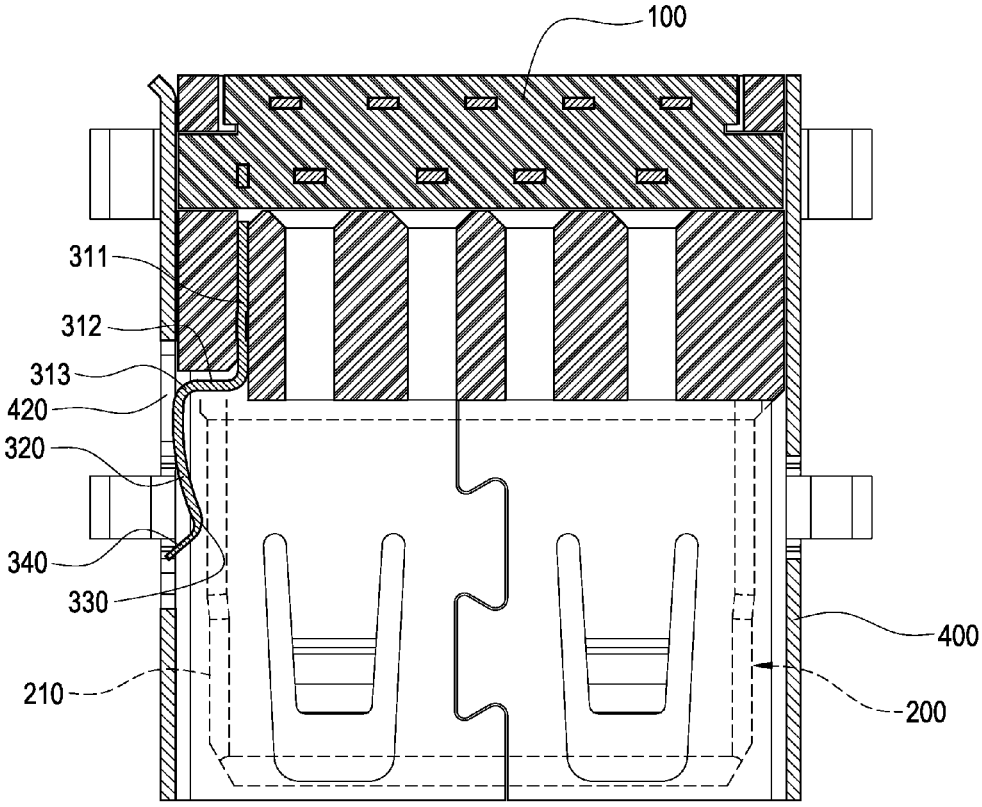
FIG. 6 is a cross-sectional view showing the electrical connector socket according to a preferred embodiment of the present invention.

Please refer to FIGS. 4 to 6. The detection terminal 300 is an elongate metallic piece made by a punching or bending process. The detection terminal 300 is preferably made of phosphor bronze (but not limited thereto) and comprises a fixed end 310, an elastic arm 320, and a contact section 330. The fixed section 310 preferably comprises a longitudinal section 311, a transverse section 312, and a bent section 313. In the present embodiment, preferably, the longitudinal section 311 is embedded in the insulation base 100 to fix the whole detection terminal 300 into the insulation base 100. However, the detection terminal 300 is still elastically movable in the insulation base 100. The longitudinal section 311 extends from the stopping surface 110 to penetrate the side wall 210. Then, the longitudinal section 311 is bent by ninety degrees along the stopping surface 110 and extends in a direction away from the side wall 210 to form the transverse section 312. The transverse section 312 is followed by the curved bent section 313. The elastic arm 320 preferably extends from the bent section 313 of the fixed end 310 in a curved manner. The bent section 313 is configured to connect the elastic arm 320 and the transverse section 312. The bent section 313 is smoothly connected to the elastic arm 320 and the connecting portions there between are two curved portions. The elastic arm 320 is formed into a curved shape with its concave surface facing the side wall 210. The contact section 330 extends from the elastic arm 320 in a curved manner to be continuously connected with the elastic arm 320. The contact section 330 is formed into a curved shape with its convex surface facing the side wall 210. The guiding section 340 straightly extends from the contact section 330 to be continuously connected with the contact section 330. The guiding section 340 extends in a direction away from the side wall 210 and the stopping surface 110. Thus, an angle is formed between the guiding section 340 and the side wall 210.

Figure 7:
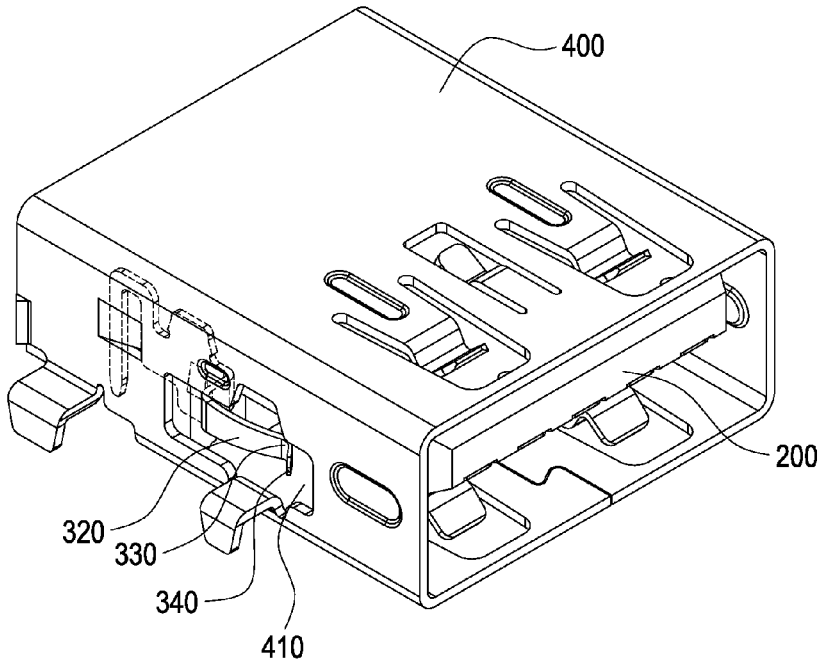
FIG. 7 is a schematic view showing the external appearance of the electrical connector socket according to a preferred embodiment of the present invention.

Please refer to FIGS. 3 and 7. The housing 400 is made by bending a metallic piece to form a cylindrical body with two open ends. One end of the housing 400 covers the insulation base 100 to surround the tongue piece 200. The housing 400 preferably comprises an action hole 410 provided on the housing 400 at a position corresponding to the detection terminal 300. Preferably, the action hole 410 corresponds to one section of the detection terminal 300 from the elastic arm 320 to the guiding section 340.

Figure 8:
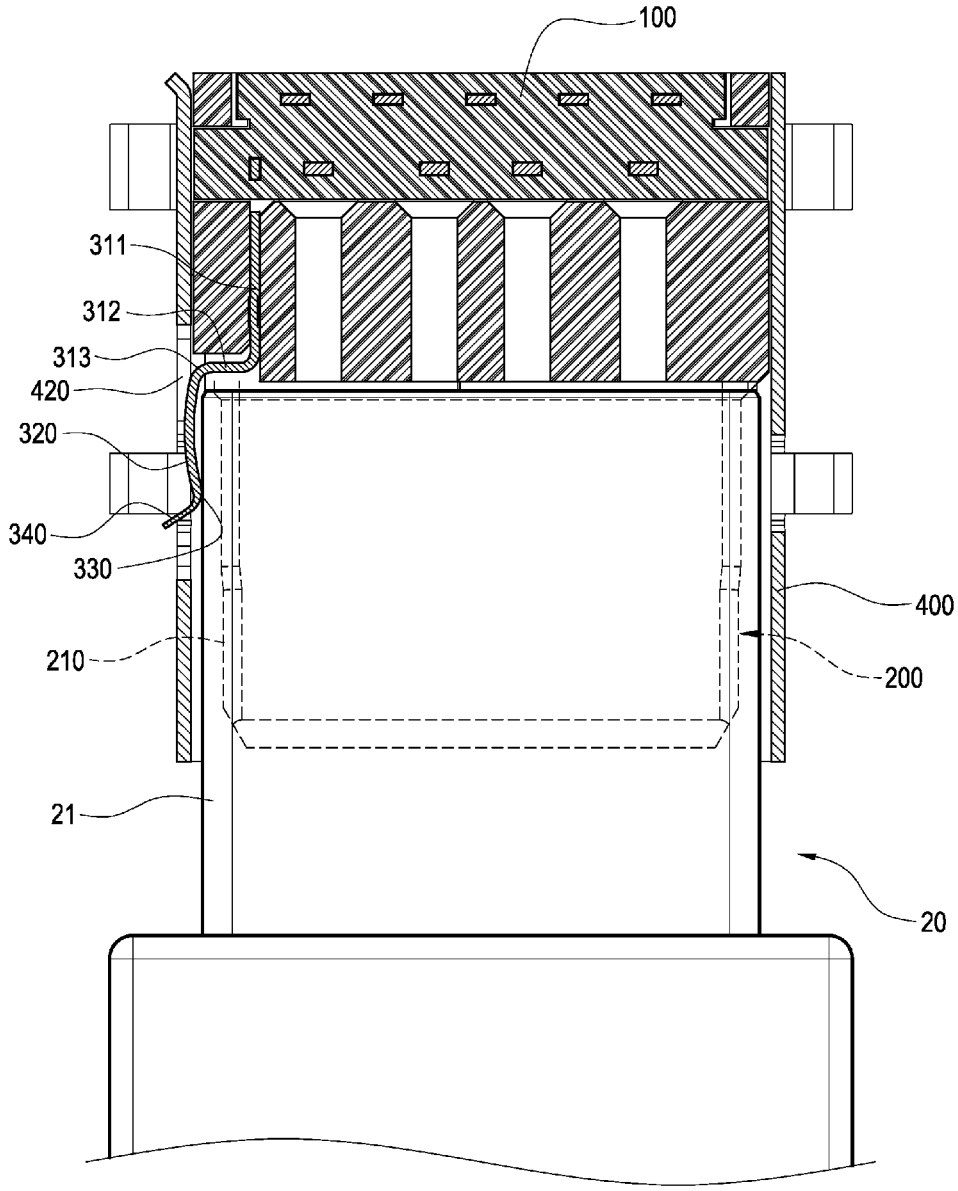
FIG. 8 is a schematic view showing the external appearance of the electrical connector socket and a corresponding electrical connector plug according to a first embodiment of the present invention.

Please refer to FIG. 8. The electrical connector socket of the present invention is used in a corresponding electrical connector plug. The electrical connector plug has an iron casing 21. The inside profile of the iron casing 21 corresponds to the outer profile of the tongue piece 200. When the electrical connector plug is inserted into the electrical connector socket of the present invention, the iron casing 21 covers the tongue piece 200.

When the iron casing 21 is inserted into the electrical connector socket of the present invention, the guiding section 340 guides the iron casing 21 to slide into the space between the detection terminal 300 and the side wall 210. As a result, the iron casing 21 forces the contact section 330 to push the elastic arm 320 outwardly. The section of the detection terminal 300 from the elastic arm 320 to the guiding section 340 will be pushed by the iron casing 21 into the action hole 410. Since the elastic arm 320 is formed into a curved shape, the elastic arm 320 is pushed by the iron casing 21, so that an action gap 420 is formed between the elastic arm 320 and the bent section 313. Thus, the iron casing 21 will not press the detection terminal 300 to damage the detection terminal 300. According to the present invention, it is unnecessary to change the original material of the elastic arm 320. By using the curved elastic arm 320 to replace the straight elastic arm 12 in prior art, the bending angle of the bent section 313 is smaller, so that the bent section 313 will not yield due to a large bending angle. Further, when the iron casing 21 pushes the elastic arm 320, the stress will be distributed on the curved elastic arm 320 without concentrating on the bent section 313 to thereby cause the fatigue and permanent deformation of the bent section 313.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A detection terminal, used in an electrical connector comprising an insulation base and a tongue piece, the insulation base comprising a stopping surface, the tongue piece extending from the insulation base, the tongue piece comprising a side wall perpendicular to the stopping surface and extending outwardly from the stopping surface, the detection terminal including:

a fixed end embedded into the insulation base;

an elastic arm extending from the fixed end in a curved manner with its concave surface facing the side wall; and a contact section continuously extending from the elastic arm in a curved manner with its convex surface facing the side wall.

2. The detection terminal according to claim 1, wherein the fixed end comprises a longitudinal section, a transverse section and a bent section, the longitudinal section is in parallel to the side wall and embedded into the insulation base, the transverse section extends from the longitudinal section along the stopping surface in a direction away from the side wall, and the bent section extends from the transverse section to form a curved shape connecting the elastic arm and the transverse section.

3. The detection terminal according to claim 1, wherein the detection terminal comprises a guiding section continuously extending from the contact section and forming an angle relative to the side wall.

4. The detection terminal according to claim 1, wherein the bent section is smoothly connected to the elastic arm.

5. An electrical connector socket, including:

an insulation base comprising a stopping surface;

a tongue piece formed as a plate and extending from the insulation base, the tongue piece comprising a side wall perpendicular to the stopping surface and extending outwardly from the stopping surface; and a detection terminal comprising a fixed end embedded in the insulation base, an elastic arm extending from the fixed end in a curved manner with its concave surface facing the side wall, and a contact section continuously extending from the elastic arm in a curved manner with its convex surface facing the side wall.

6. The electrical connector socket according to claim 5, further comprising a housing covering the insulation base and surrounding the tongue piece, the housing being provided with an action hole at a position corresponding to the detection terminal.

7. The electrical connector socket according to claim 6, wherein the elastic arm is located in the action hole.

8. The electrical connector socket according to claim 5, wherein the fixed end comprises a longitudinal section, a transverse section and a bent section, the longitudinal section is in parallel to the side wall and embedded in the insulation base, the longitudinal section extends from the longitudinal section along the stopping surface in a direction away from the side wall, and the bent section extends from the transverse section to form a curved shape connecting the elastic arm and the transverse section.

9. The electrical connector socket according to claim 5, wherein the detection terminal comprises a guiding section continuously extending from the contact section and forming an angle relative to the side wall.

10. The electrical connector socket according to claim 5, wherein the bent section is smoothly connected to the elastic arm.

* * * * *